US012662346B2

(12) United States Patent
Rozenfeld et al.

(10) Patent No.: US 12,662,346 B2
(45) Date of Patent: Jun. 23, 2026

(54) AUTOMATED CONTROL OF ON-EDGE ENVELOPE STACKING

(71) Applicant: DMT Solutions Global Corporation, Danbury, CT (US)

(72) Inventors: Boris Rozenfeld, Danbury, CT (US); Xavier A. Padros, New Milford, CT (US); Matthew O. Dickie, Sandy Hook, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 34 days.

(21) Appl. No.: 18/585,479

(22) Filed: Feb. 23, 2024

(65) Prior Publication Data

US 2024/0286860 A1 Aug. 29, 2024

Related U.S. Application Data

(60) Provisional application No. 63/448,302, filed on Feb. 26, 2023.

(51) Int. Cl.

| | |
|---|---|
| ***B65H 31/06*** | (2006.01) |
| ***B65H 29/14*** | (2006.01) |
| ***B65H 43/00*** | (2006.01) |
| ***B65H 43/08*** | (2006.01) |

(52) U.S. Cl.

CPC ..... *B65H 31/06* (2013.01); *B65H 29/14* (2013.01); *B65H 43/00* (2013.01); *B65H 43/08* (2013.01); *B65H 2301/33222* (2013.01); *B65H 2511/13* (2013.01); *B65H 2515/30* (2013.01)

(58) Field of Classification Search

CPC ..... B65H 29/12; B65H 29/125; B65H 29/14; B65H 31/04; B65H 31/06; B65H 43/00; B65H 43/02; B65H 43/08; B65H 2301/33222; B65H 2511/13; B65H 2515/30; B65H 2515/34

USPC ..... 271/225

See application file for complete search history.

(56) References Cited

U.S. PATENT DOCUMENTS

| | | | | |
|---|---|---|---|---|
| 4,903,955 | A * | 2/1990 | Manzke | B65H 31/06 271/179 |
| 6,398,204 | B1 | 6/2002 | Keane et al. | |
| 6,682,067 | B1 * | 1/2004 | Keane | B65H 33/06 271/181 |
| 7,344,134 | B1 | 3/2008 | Keane et al. | |
| 2002/0017447 | A1 * | 2/2002 | Emigh | B65H 29/12 198/610 |
| 2004/0080096 | A1 * | 4/2004 | Holbrook | B65H 31/06 271/185 |
| 2007/0176348 | A1 | 8/2007 | Schererz et al. | |
| 2013/0294879 | A1 * | 11/2013 | Middleberg | B65H 33/06 414/798.2 |

(Continued)

OTHER PUBLICATIONS

International Search Report and Written Opinion mailed Jun. 14, 2024, for Application No. PCT/US2024/017030 filed Feb. 23, 2024 (15 pages).

*Primary Examiner* — Prasad V Gokhale

(74) *Attorney, Agent, or Firm* — Brown Rudnick LLP; Matthew P. York

(57) ABSTRACT

The present invention provides systems and methods for controlling on-edge stacking of mailpieces and maintaining a constant ideal stack pressure of a given stack of mailpieces in an autonomous manner.

15 Claims, 11 Drawing Sheets

(56) References Cited

U.S. PATENT DOCUMENTS

| | | | | |
|---|---|---|---|---|
| 2014/0271087 | A1 | 9/2014 | Brown et al. | |
| 2016/0304293 | A1* | 10/2016 | Kirkpatrick, Jr. ..... | B65G 37/00 |

* cited by examiner

AUTOMATED CONTROL OF ON-EDGE ENVELOPE STACKING

CROSS-REFERENCE TO RELATED APPLICATIONS

This application claims priority to, and the benefit of, U.S. Provisional Application No. 63/448,302, filed Feb. 26, 2023, the content of which is incorporated by reference herein in its entirety.

TECHNICAL FIELD

The present disclosure relates generally to mass mailpiece handling systems, and, more particularly, to a system for providing automated on-edge stacking of mailpieces for subsequent processing and mailing.

BACKGROUND

Direct mail is an important tool for businesses to communicate with customers. In various mass mailing preparations, a mail package may include one or more documents, which may be folded and/or combined with cards or other inserts, all of which must be inserted into an envelope or other form of packaging, which is then sealed, addressed, and stamped for mailing. As such, many businesses turn to mailpiece fabrication systems, such as mailpiece inserters and mailpiece wrappers, to periodically produce a large volume of mail.

Mailpiece fabrication systems are analogous to automated assembly equipment in that sheets, inserts and envelopes are conveyed along a feed path and assembled in, or at, various modules of the mailpiece fabrication system. For example, a mail insertion system or a "mailpiece inserter" is commonly employed for producing mailpieces intended for mass mail communications. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

For example, the typical inserter system resembles a manufacturing assembly line. Sheets and other raw materials (e.g., other sheets, enclosures, and envelopes) enter the inserter system as inputs. Then, a plurality of different modules or workstations in the inserter system cooperatively operate to process the sheets until a finished mailpiece is produced (i.e., contents of a given mailpiece are eventually placed within an envelope, package, or other carrier-type article and ready for mailing). Once filled, the envelopes are closed, sealed, weighed, and sorted. A postage meter may then be used to apply postage indicia based upon the weight and/or size of the mail piece.

The mailpieces can then be moved to a stacker where mailpieces are collected and stacked, either on-edge or laid flat. For example, an exemplary on-edge stacker, or vertical stacker, is depicted in U.S. Pat. No. 6,398,204, titled "On-Edge Stacking Apparatus", which is hereby incorporated by reference in its entirety. Such an on-edge stacking apparatus accepts envelopes in a flat condition, reorients them approximately 90 degrees to an on-edge position, and stacks the envelopes in a desired order, typically along a conveyor belt (also referred to herein as a "stack accumulating belt"), wherein such stacks of envelopes can then be picked up and placed within trays for subsequent mailing.

Advances in the art of mailpiece inserters have vastly increased the total mailpiece volume and rate of mailpiece production. As such, certain metrics have been used in an attempt to measure machine efficiency of inserter systems, including a metric known as "Mean Pieces Between Errors". The overall goal is to maximize this number (i.e., increase the mean number of pieces between errors) by reducing the number of paper jam stoppages caused by machine errors. However, it has been observed that current on-edge stacker assemblies can significantly contribute to the total number of errors per a given time period for certain insertion applications. More specifically, current on-edge stacker systems may generally include control inputs allowing for adjustment of certain parameters of the stacker, including pressure switches or knobs that can be manually adjusted by an operator as needed to account for mailpiece characteristics (i.e., mailpiece size, mailpiece thickness, etc.). However, it is difficult to maintain a consistent stack pressure after several hundred envelopes are collated on the stack accumulating belt using such manual control inputs, which thereby results in a high number of machine jam stoppages that directly correlate to the poor output stack quality.

SUMMARY

The present invention addresses drawbacks of current stacking techniques, specifically by providing a system for controlling on-edge stacking of mailpieces and maintaining a constant ideal stack pressure of a given stack of mailpieces in an autonomous manner.

In particular, the system of the present invention includes various sensors arranged within an on-edge stacker module, including at least a first sensor configured to measure the thickness of each incoming mailpiece to be stacked, on-edge, and collated with other stacked mailpieces on an accumulating belt, as well as a second sensor configured to measure the pressure of the current stack on the accumulating belt. The system further includes a controller running a stack accumulating belt control algorithm that uses input from the various sensors, including input from the first and second sensors, to thereby provide autonomous control over movement of the accumulating belt so as to maintain a constant ideal stack pressure for a given stack of mailpieces as each incoming mailpiece is received and subsequently stacked.

Accordingly, the present invention essentially provides a closed loop system configured to automatically adjust movement of the accumulator belt on-the-fly by accounting for at least a thickness of each successive incoming mailpiece, such that each incoming mailpiece can be accommodated within a given stack provided at the mailpiece stacking section while maintaining a constant ideal stack pressure for that given stack. As a result, the system of the present invention provides improved quality of a resulting stack of mailpieces. Furthermore, the system of the present invention removes the need for constant manual adjustments to account for changes in mailpiece characteristics, specifically any changes in a given mailpiece thickness, and therefore greatly reduces the number of errors (i.e., jams and the like) from occurring and thus provides a significant improvement in the mean number of pieces produced between errors at the stacker module.

BRIEF DESCRIPTION OF THE DRAWINGS

Features and advantages of the claimed subject matter will be apparent from the following detailed description of embodiments consistent therewith, which description should be considered with reference to the accompanying drawings.

FIG. 1 is a block diagram schematic of a document inserter system in which the on-edge stacker module of the present invention is operably coupled to.

Figure 1:
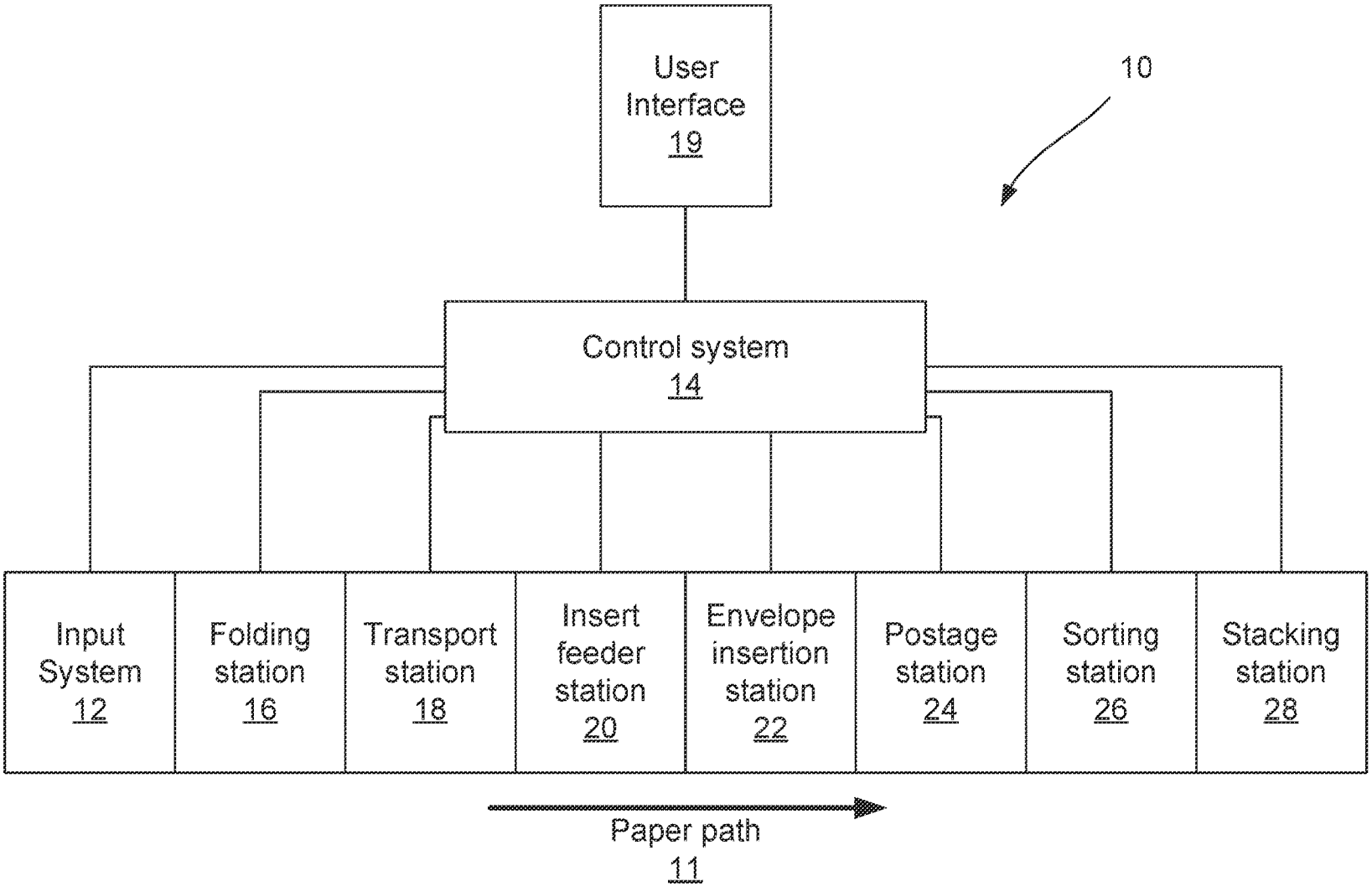

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient.

DETAILED DESCRIPTION

By way of overview, the present invention is directed to systems and methods for controlling on-edge stacking of mailpieces and maintaining a constant ideal stack pressure of a given stack of mailpieces in an autonomous manner. In particular, the present invention includes an on-edge stacker module that includes various sensors, including at least a first sensor configured to measure the thickness of each incoming mailpiece to be stacked, on-edge, and collated with other stacked mailpieces on an accumulating belt, as well as a second sensor configured to measure the pressure of the current stack on the accumulating belt. A controller running a stack accumulating belt control algorithm uses input from the various sensors, including input from the first and second sensors, to thereby provide autonomous control over movement of the accumulating belt so as to maintain a constant ideal stack pressure for a given stack of mailpieces as each incoming mailpiece is received and subsequently stacked.

Accordingly, the present invention essentially provides a closed loop system configured to automatically adjust movement of the accumulator belt on-the-fly by accounting for at least a thickness of each successive incoming mailpiece, such that each incoming mailpiece can be accommodated within a given stack provided at the mailpiece stacking section while maintaining a constant ideal stack pressure for that given stack. As a result, the system of the present invention provides improved quality of a resulting stack of mailpieces. Furthermore, the system of the present invention removes the need for constant manual adjustments to account for changes in mailpiece characteristics, specifically any changes in a given mailpiece thickness, and therefore greatly reduces the number of errors (i.e., jams and the like) from occurring and thus provides a significant improvement in the mean number of pieces produced between errors at the stacker module As described in greater detail herein, the on-edge stacker module can generally be incorporated into a production mail inserter, thereby allowing for the stacker module to receive finished mailpieces from the inserter (generally in a flat, substantially horizontal orientation) reorient said mailpieces approximately 90 degrees to an on-edge position, and stack the mailpieces in a desired order, wherein such stacks of envelopes can then be picked up and placed within trays for subsequent mailing. For example, the on-edge stacker module can be incorporated into, or otherwise operably associated with, modular inserter platforms, including, but not limited to, any one of the EVOLUTION™, MAILSTREAM EVOLUTION™, RIVAL™, and EPIC™ inserter platforms available from DMT Solutions Global Corporation dba BlueCrest (Danbury, CT).

FIG. 1 is a block diagram schematic of an exemplary document inserter system 10 in which the on-edge stacker module of the present invention is operably coupled to. The document inserting system 10 includes several stations or modules. The document insertion system 10 is illustrative and many other configurations may be utilized.

The system 10 includes an input system 12 that feeds paper sheets from a paper web to an accumulating station that accumulates the sheets of paper in collation packets. In some embodiments, only a single sheet of a collation is coded (the control document), which coded information can be one input into the control system 14. The control system includes a processor configured to execute instructions that control the processing of documents in the various stations of the mass mailing inserter system 10. The system 10 may include a user interface 19 for controlling one or more user inputs and displaying one or more outputs from the system 10, allowing a user to interact with and control the operation of the system, can be physically connected to the system or can be located remotely. The user interface 19 can include a screen such as a touchscreen configured to display operating conditions and parameters of the inserter system 10 to a user. The user interface 19 can include other input devices such as a keyboard/keypad or a mouse.

The input system 12 is configured to feed sheets in a paper path, as indicated by arrow 11, along what is known as the main deck of inserter system 10. After sheets are accumulated into collations by input system 12, the collations are folded in folding station 16 and the folded collations are then conveyed to a transport station 18, preferably operative to perform buffering operations for maintaining a proper timing scheme for the processing of documents in insertion system 10.

Each sheet collation is fed from the transport station 18 to an insert feeder station 20. It should be noted that an inserter system 10 may include a plurality of feeder stations, but for clarity, only a single insert feeder 20 is shown. The insert feeder station 20 is configured to convey an insert (e.g., an advertisement or the like) from a supply tray to the main deck of inserter system 10 so as to be combined with the sheet collation conveying along the main deck. The sheet collation along with nested insert(s) are next conveyed into envelope insertion station 22 that is operative to open an unsealed envelope and insert the collation into the opening of the envelope.

The filled envelope may then be conveyed to a station for sealing and/or rearranging the filled envelope for subsequent processing. For example, in some embodiments, the system 10 may include a sealing and flipping station that is operable to wet the adhesive substance on the flap of the envelope, rotate the envelope into a face-up orientation, and seal the envelope by pressing the flap against the body of the envelope. The filled and sealed envelope is then conveyed to postage station 24. In some embodiments, the envelope may then be conveyed to sorting station 26 that sorts the envelopes.

It should be noted that the inserter system 10 may include additional stations/modules for performing additional tasks. For example, mailpiece inserter systems may include a variety of apparatus/modules for conveying and processing a substrate/sheet material along the feed path, in addition to those stations/modules described herein. For example, inserter systems consistent with the present disclosure may further include apparatus/modules for: (i) accumulating printed content to form a multi-sheet collation in an "accumulator"; (ii) folding the content to produce a variety of fold configurations such as a C-fold, Z-fold, bi-fold and gate fold, in a "folder"; (iii) feeding mailpiece inserts such as coupons, brochures, and pamphlets, in combination with the content, in a "chassis module"; and (iv) printing recipient/return addresses and/or postage indicia on the face of the mailpiece envelope at a "print station".

Finished mailpieces may then be passed along to a stacking station 28, which generally includes an on-edge stacker module configured to stack finished mailpieces vertically (i.e., on any of the edge of the finished mail from a flat, substantially horizontal position). The on-edge stacker module, in combination with the control system 14, is configured to control on-edge stacking of mailpieces and maintain a constant ideal stack pressure of a given stack of mailpieces in an autonomous manner. In particular, as will be described in greater detail herein, various sensors are arranged within the on-edge stacker module, including at least a first sensor configured to measure the thickness of each incoming mailpiece to be stacked, on-edge, and collated with other stacked mailpieces on a stack accumulating belt of the stacker module, as well as a second sensor configured to measure a pressure of a current stack on the accumulating belt. The control system 14 is configured to run a stack accumulating belt control algorithm that uses input from the various sensors, including input from the first and second sensors, to thereby provide autonomous control over movement of the stack accumulating belt so as to maintain a constant ideal stack pressure for a given stack of mailpieces as each incoming mailpiece is received and subsequently stacked.

Figure 2:
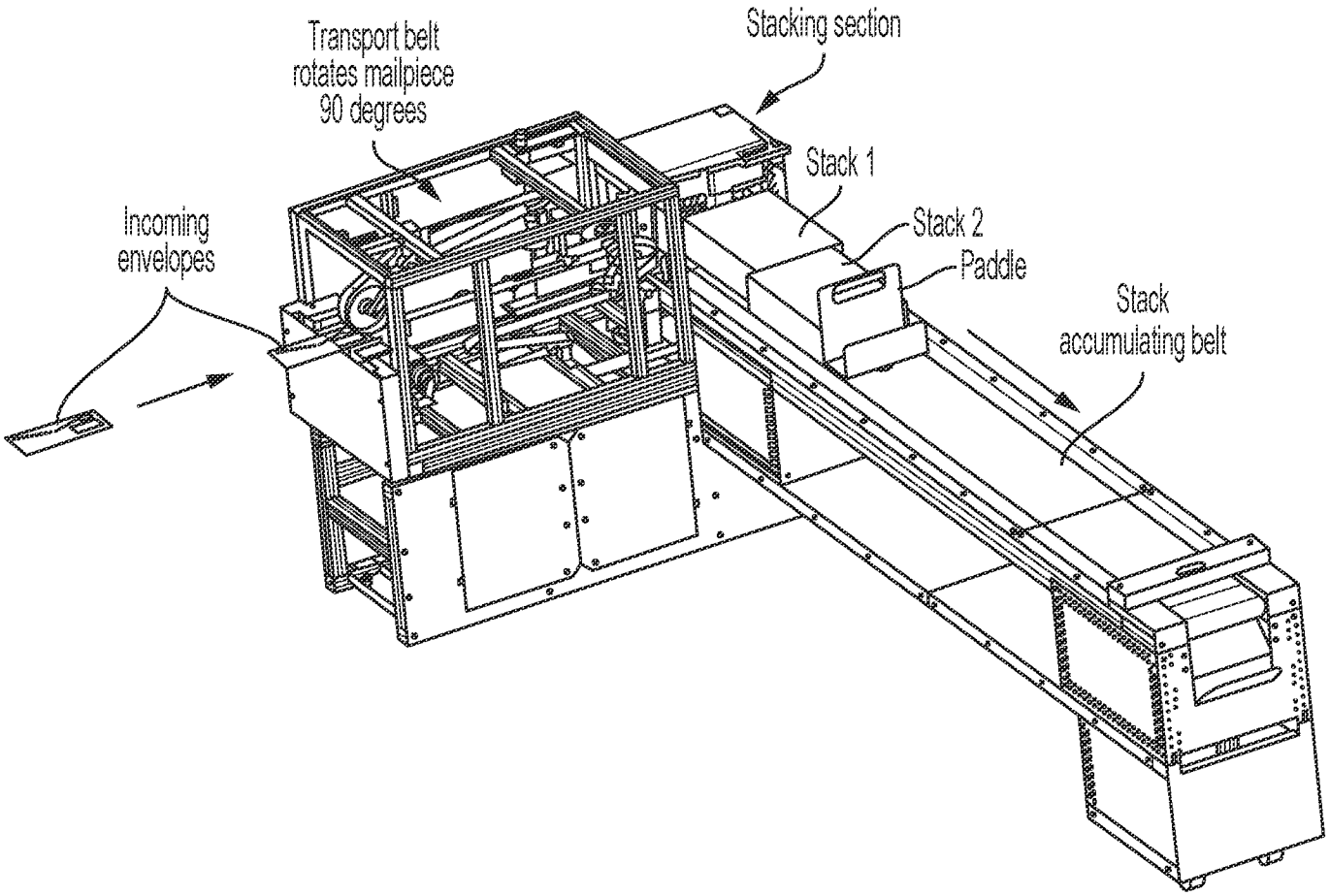
FIG. 2 is a perspective view of an exemplary on-edge stacker module consistent with the present disclosure.

FIG. 2 is a perspective view of an exemplary on-edge stacker module consistent with the present disclosure. As shown, finished mailpieces (illustrated as envelopes) are received and pass through various sections of the stacker module. In particular, envelopes pass through, in a serial fashion, a first section in which a belt turn-up assembly rotates the envelope from a generally flat and substantially horizontal orientation to an on-edge orientation (i.e., rotation of approximately 90 degrees). The on-edge envelopes then pass into a stacking section configured to insert a given envelope into the rear portion of an envelope stack (i.e., a plurality of on-edge envelopes) placed onto a conveyor (i.e., a stack accumulating belt). A paddle member may be included on the stack accumulating belt and may be useful when first establishing a stack of on-edge mailpieces. It should be noted, however, that in some embodiments, the paddle member is not necessary in order to hold and maintain a stack of given mailpieces.

In some embodiments, the stacking section may include offsetting capabilities, in which certain set of finished mail on the conveyer can be shifted during stacking formation, as compared to another set of finished mail, such that stacks of envelopes can be offset from one another on the accumulating belt. The offsetting function may primarily be used to indicate zip breaks in the mail. When there is a zip break in the mail, it typically indicates the start of a new tray of mail, which is advantageous because it informs the system when to start filling a new tray. As a result, when the system detects a zip code break, a new tray is placed in the tray loading station and the system begins the process of filling up the new tray.

Figure 3:
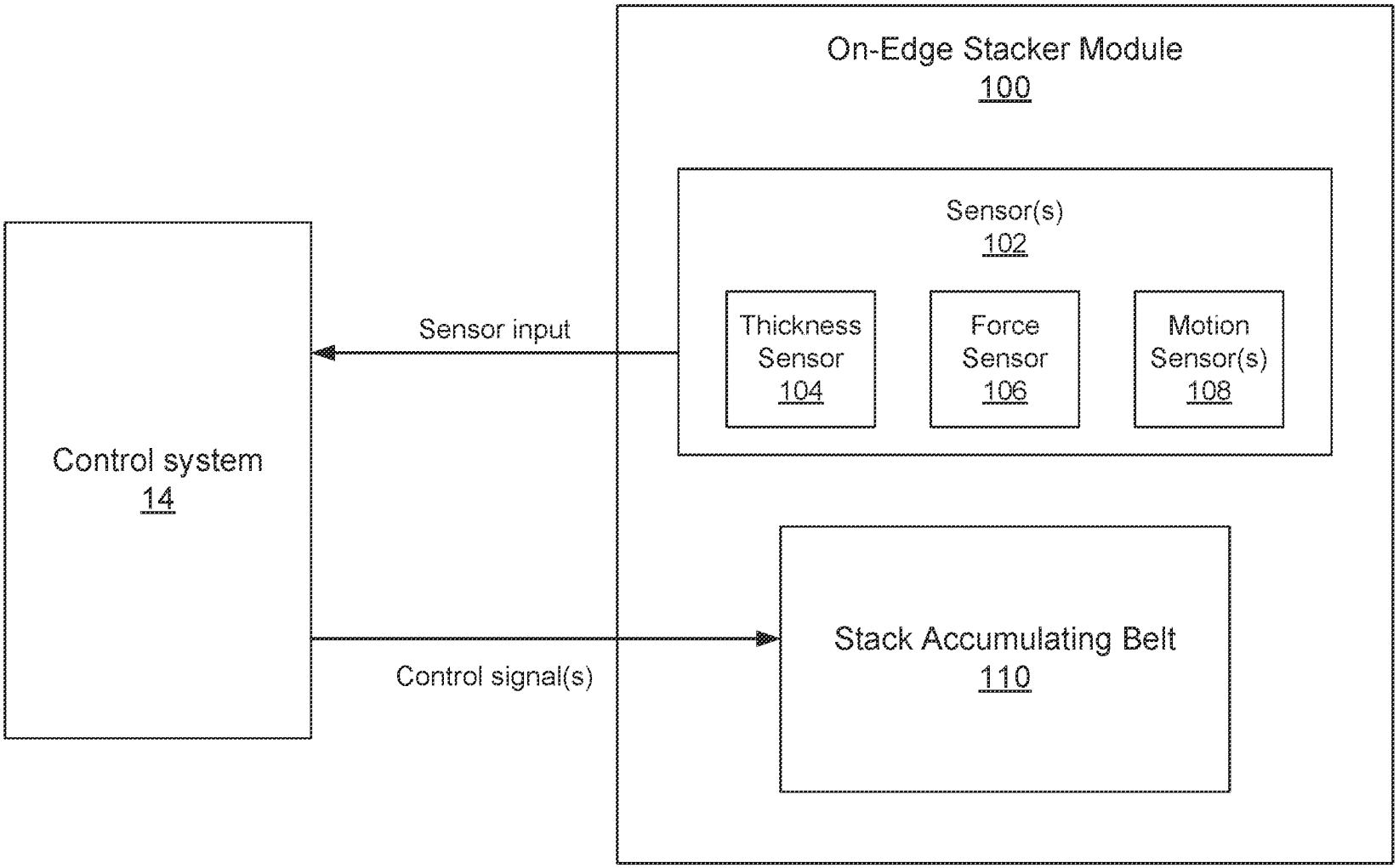
FIG. 3 is a block diagram illustrating communication of input from various sensors arranged on the on-edge stacker module and subsequent control over at least movement of the accumulating belt based on the sensor input.

FIG. 3 is a block diagram illustrating communication of input from various sensors arranged on the on-edge stacker module 100 and subsequent control over at least movement of the stack accumulating belt 110 based on the sensor input. As previously described herein, the stacker module 100 includes various sensors 102, wherein some sensors are configured to detect or measure physical properties associated with one or more envelopes during movement of said envelopes through various sections of the stacker module, while other sensors are configured to detect or measure physical properties of one or more resulting stacks of on-edge envelopes. For example, the sensors 102 may include: a thickness sensor 104 configured to measure the thickness of each incoming envelope prior to being turned on-edge and collated with other stacked mailpieces on the accumulating belt; a force sensor 106 configured to measure the pressure of a current stack of on-edge envelopes on the accumulating belt; and one or more motion sensors 108 configured to detect the presence of an incoming envelope to the stack module 100 (i.e., an entrance sensor) and configured to detect the presence of an on-edge envelope as it enters the stacking section (i.e., an exit sensor). The control system 14 is configured to run a stack accumulating belt control algorithm that uses input from the various sensors 102 to thereby provide autonomous control over movement of the accumulating belt so as to maintain a constant ideal stack pressure for a given stack of mailpieces as each incoming mailpiece is received and subsequently stacked.

Figure 4:
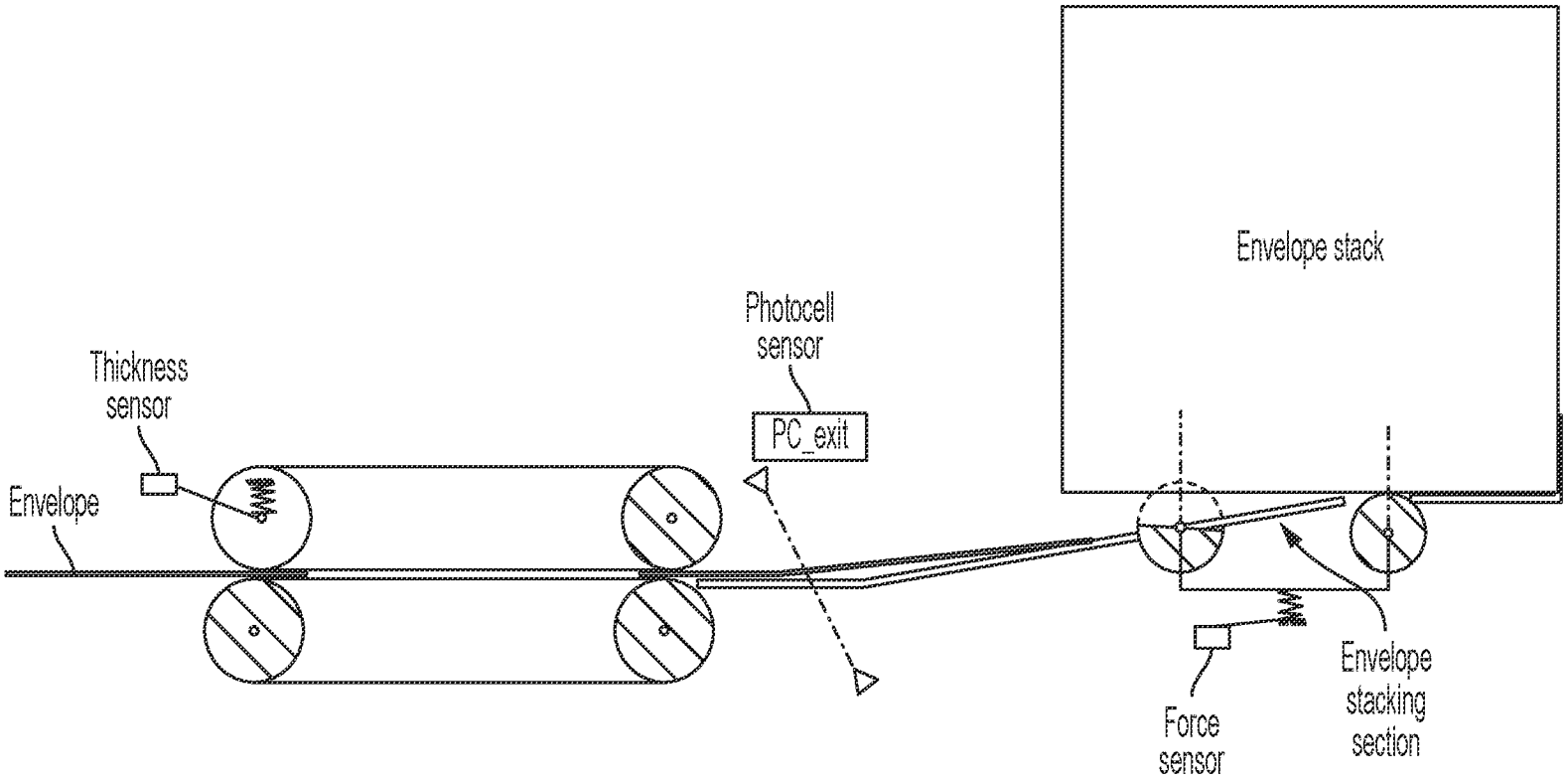
FIG. 4 is a schematic side view of the on-edge stacker module illustrating various sensors arranged thereon and configured to detect or measure physical properties associated with one or more envelopes during movement of said envelopes through various sections of the stacker module, as well physical properties of one or more resulting stacks of on-edge envelopes.

FIG. 4 is a schematic side view of the on-edge stacker module illustrating the various sensors arranged thereon. As shown, a thickness sensor is used to measure the thickness of each incoming envelope using an encoder or the like. The force sensor is configured to measure a force applied by the envelope stack against the envelope stacking section via a load cell or the like. A photocell sensor, for example, may be used to detects the arrival of an envelope that has passed through the belt turn-up assembly and rotated to the on-edge position which, in turn, results in the initiation of measurement of the force of the envelope stack (i.e., stack force).

The on-edge stacker module communicates with the control system. In particular, the control system may include standard processors, controllers, and motors as used in the mail handling equipment field. In an exemplary embodiment, the controller may include a programmable logic controller (PLC), a specialized small computer with a built-in operating system designed specifically for controlling machinery. PLC operating systems are able to process incoming events and to react in real time. Another advantage of a PLC is that it is designed to operate reliably in an industrial environment.

The PLC has input lines where sensors are connected to notify upon events (e.g. pressures above/below a certain level, envelopes sensed at a particular location, etc.), and it has output lines to signal any reaction to the incoming events (e.g. feed an envelope, move the accumulating belt, etc.). Where the system includes analog sensors (for example analog pressure sensors) an A/D converter is used to generate the digital signal for input into the PLC. The system is user programmable using standard PLC programming language. Ladder logic programming is used in the preferred embodiment for programming the PLC for the functionality described herein.

In one embodiment, the present invention essentially provides a closed loop system configured to automatically adjust movement of the accumulator belt on-the-fly by accounting for at least a thickness of each successive incoming mailpiece, such that each incoming mailpiece can be accommodated within a given stack provided at the mailpiece stacking section while maintaining a constant ideal stack pressure for that given stack. For example, the control system 14 may include a controller running a stack accumulating belt control algorithm that uses input from the various sensors, including input from at least the thickness sensor and the force sensor, to thereby provide autonomous control over movement of the accumulating belt so as to maintain a constant ideal stack pressure for a given stack of mailpieces as each incoming mailpiece is received and subsequently stacked.

When an envelope arrives at the stacking section, the force sensor is sampled and the force reading is compared to the ideal stack force configuration setting. If the measured stack force is less than an ideal force setpoint, then the accumulating belt is stopped if already moving and will remain stopped until the next envelope arrives. If the measured stack force is greater than the ideal force setpoint, then the accumulating belt indexes forward a certain distance, as calculated by the stack accumulating belt control algorithm.

The stack accumulating belt control algorithm is based on the following equations (Equations 1, 2, and 3):

EQUATION 1

$$dist_{belt}(U) := \text{if } U < U_z + \delta U_0 \;\|\; 0 \;\text{else}\; \left\| \left\| \text{thickness}_{mail} \right| \cdot \left(1 + \frac{K \cdot ((U - U_z) - \delta U_0)}{\delta U_0}\right) \right|$$

where U is the load cell voltage, $U_z$ is the voltage during zero pressure or during calibration, and $\delta U_0$ is the ideal stack pressure (i.e., the ideal voltage change from 0).

EQUATION 2

$$K(\text{thickness}_{mail}) := \left\| \text{if } \left\|\text{thickness}_{mail}\right| \le \text{thick_mail} \;\|\; a \cdot \text{thickness}_{mail} + b \;\text{else}\; K_{thick} \right\|$$

where K is the gain factor, which is not constant, but automatically varied based on thicknesses of incoming envelopes. If below a thickness that is less than thick, the gain is varied based on a linear function (of Equation 3).

EQUATION 3

$$a := \frac{K_{thick} - K_{thin}}{\text{thick_mail} - \text{thin_mail}}$$

$$b := K_{thin} - a \cdot \text{thin_mail}$$

Where a and b are the line slope and the intercept of the linear function, respectively.

As illustrated in Equations 1, 2 and 3, the stack accumulating belt control algorithm uses the incoming envelope's measured thickness and the difference between actual ($U-U_z$) and desired ($\delta U_0$) stack force in combination with a tuning gain factor (K) that varies with envelope thickness to calculate the distance the stacking belt should move before the next envelope arrives and is inserted.

Figure 5:
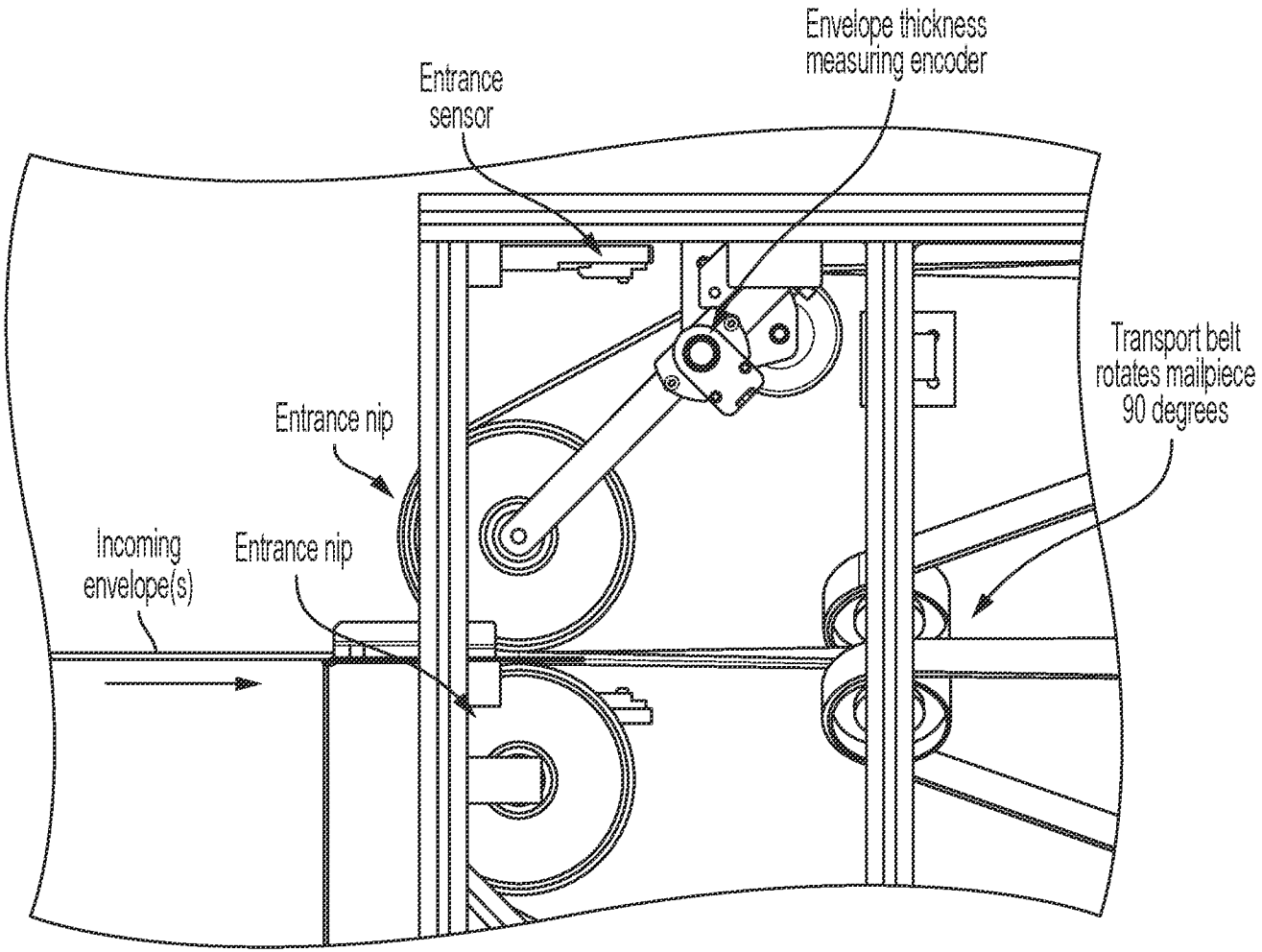
FIG. 5 is an enlarged view, partly in section, of the on-edge stacker module illustrating the processing of an incoming envelope and the associated sensors for sensing an incoming envelope and subsequently measuring a thickness of said incoming envelope prior to inverting the envelope from a substantially flat or horizontal orientation to an on-edge orientation.

FIG. 5 is an enlarged view, partly in section, of the on-edge stacker module illustrating the processing of an incoming envelope and the associated sensors for sensing an incoming envelope and subsequently measuring a thickness of said incoming envelope prior to inverting the envelope from a substantially flat or horizontal orientation to an on-edge orientation. As previously described, envelopes are received in a first section of the module, which includes a belt turn-up assembly that rotates the envelope from a generally flat and substantially horizontal orientation to an on-edge orientation (i.e., rotation of approximately 90 degrees). As the envelope passes through entrance nips, the thickness of the given envelope is measured via an encoder.

Figure 6:
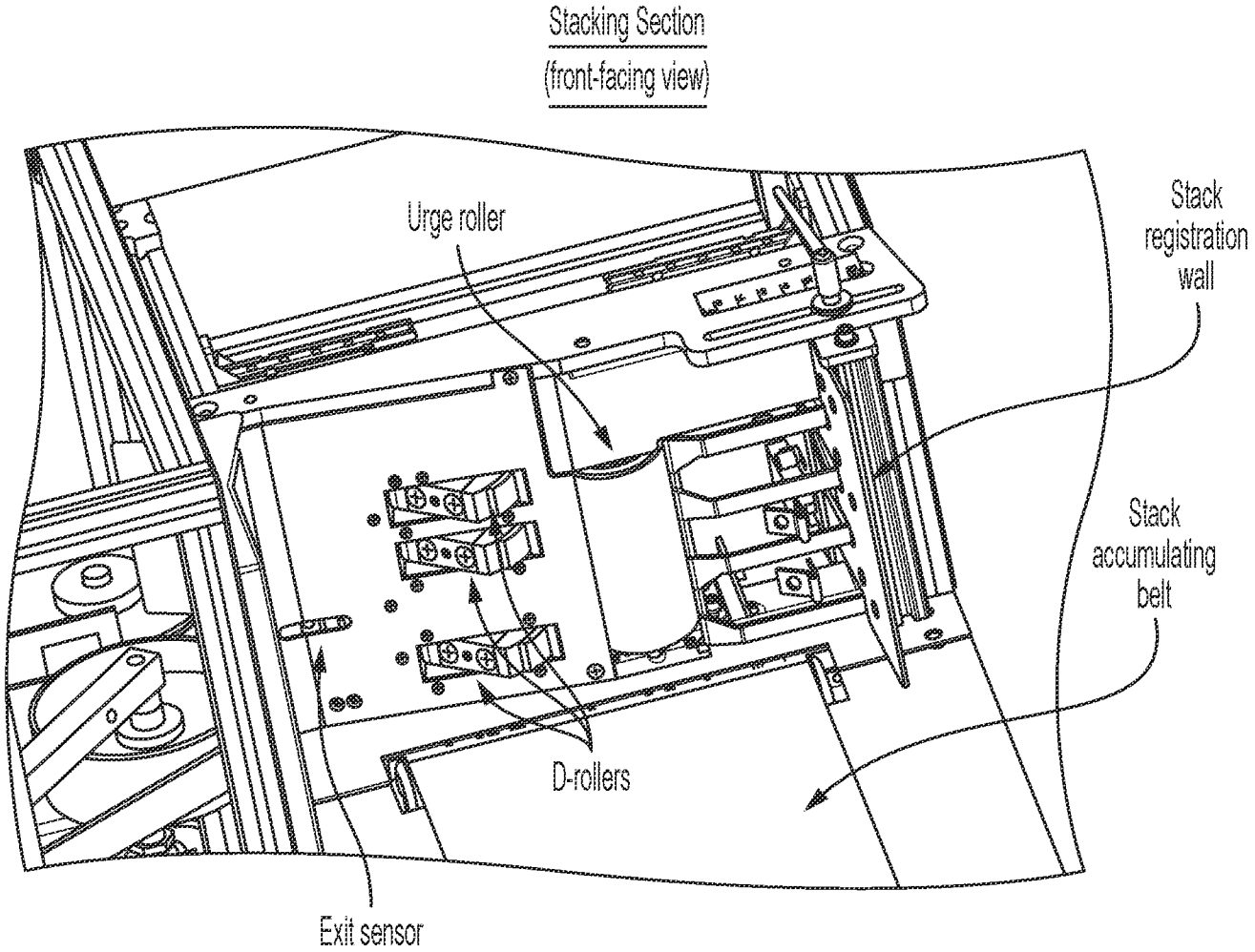
FIGS. 6 and 7 are enlarged, front-facing and rear-facing views, respectively, of the stacking section of the on-edge stacker module illustrating the processing of an on-edge envelope and the associated sensors for sensing the incoming on-edge envelope and subsequently measuring a force applied upon the envelope stacking section (i.e., via a load cell) to determine appropriate movement of the accumulating belt and subsequent insertion of the on-edge envelope into the stack.
Figure 7:
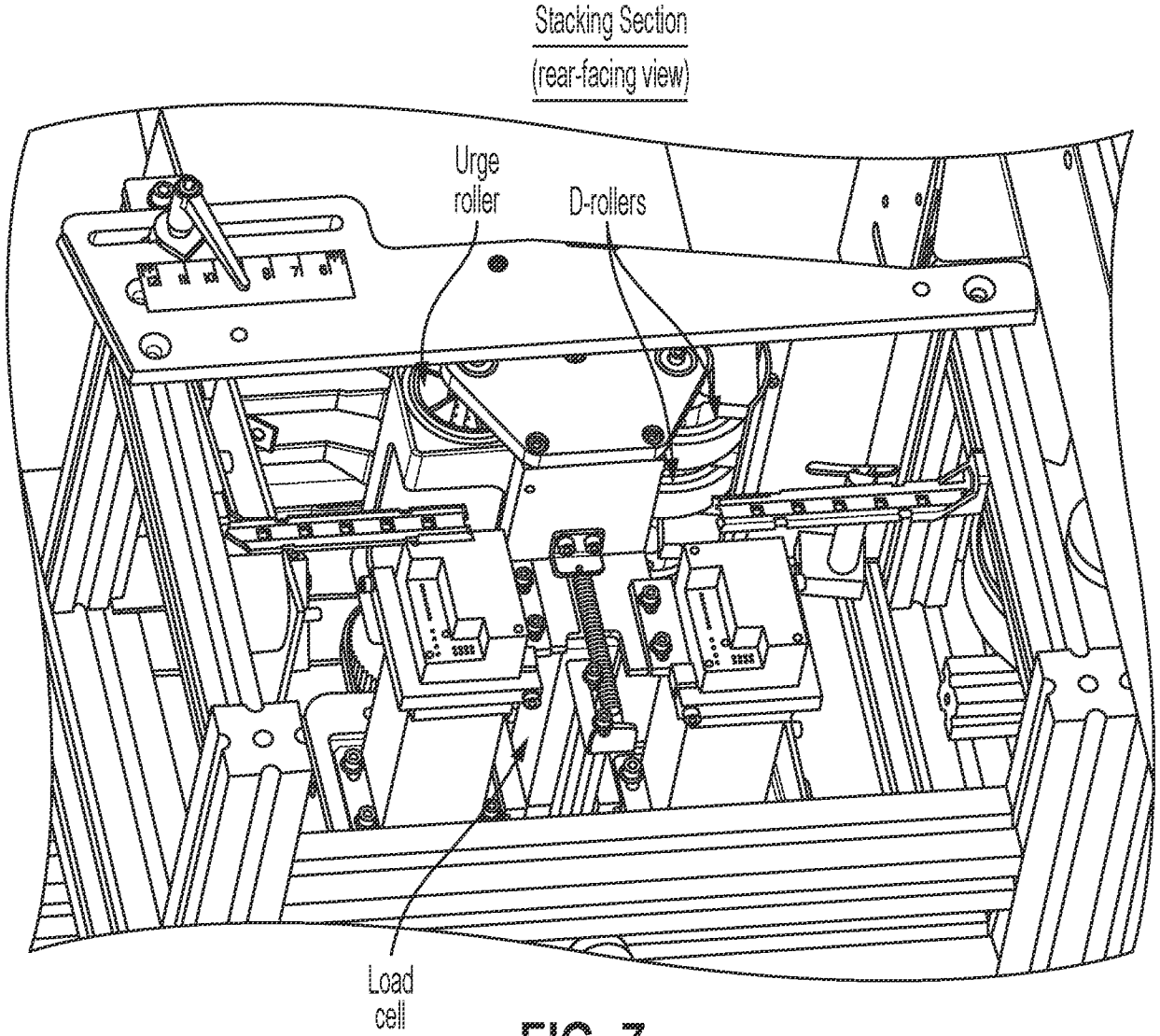
Figure 8A:
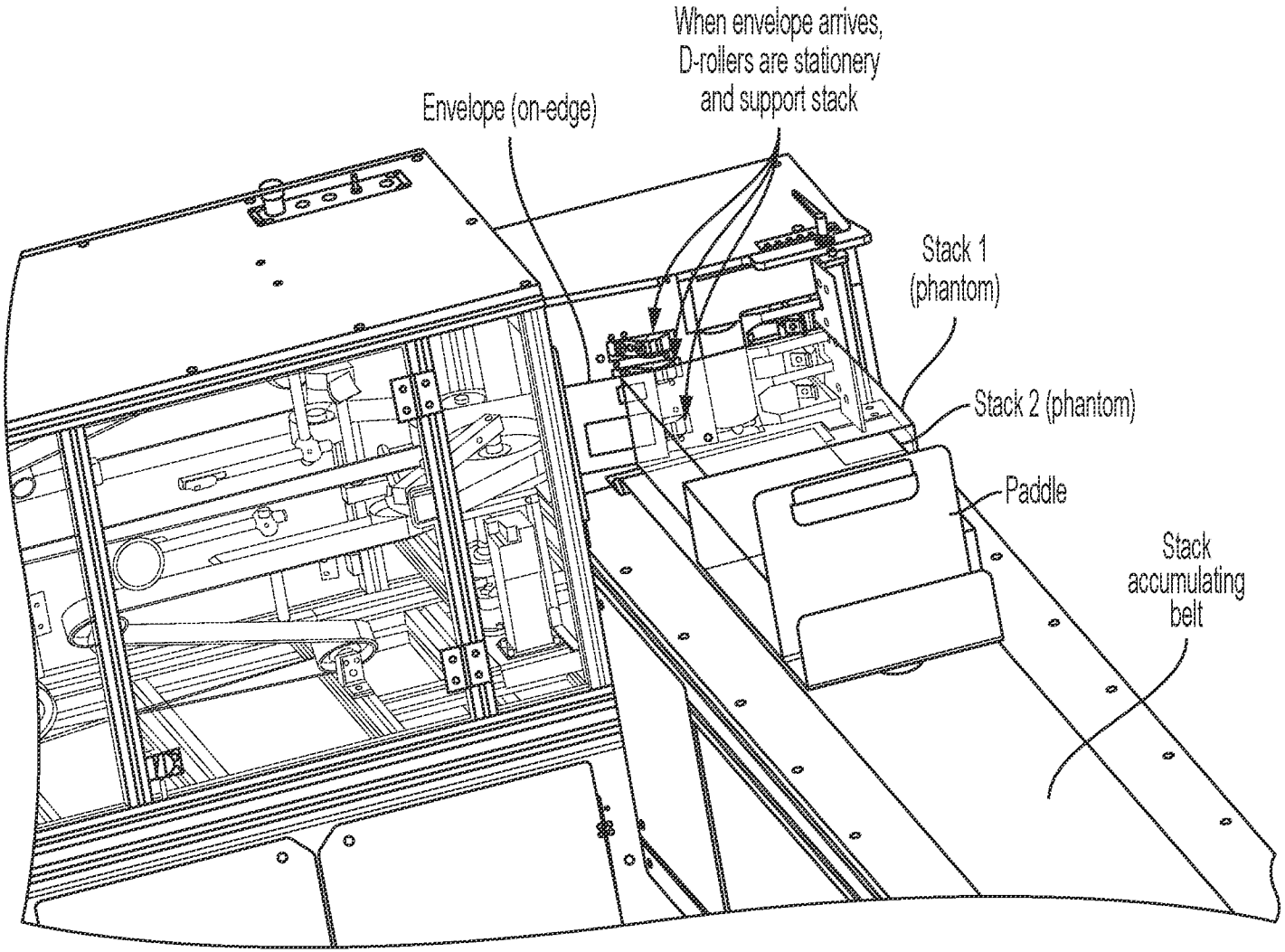
FIGS. 8A and 8B are enlarged, perspective views of the stacking section of the on-edge stacker module illustrating movement of the on-edge envelope into the stack.
Figure 8B:
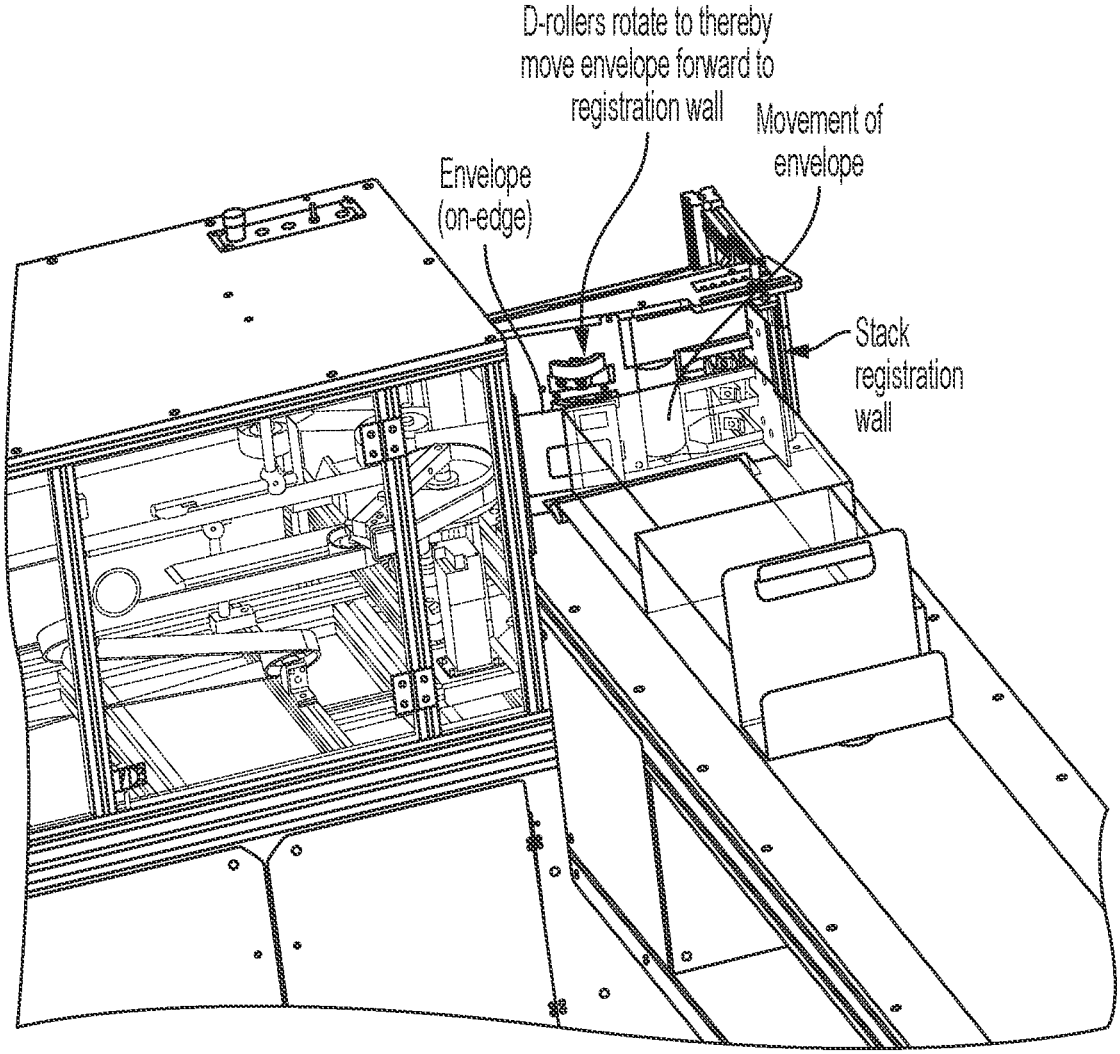
Figure 9:
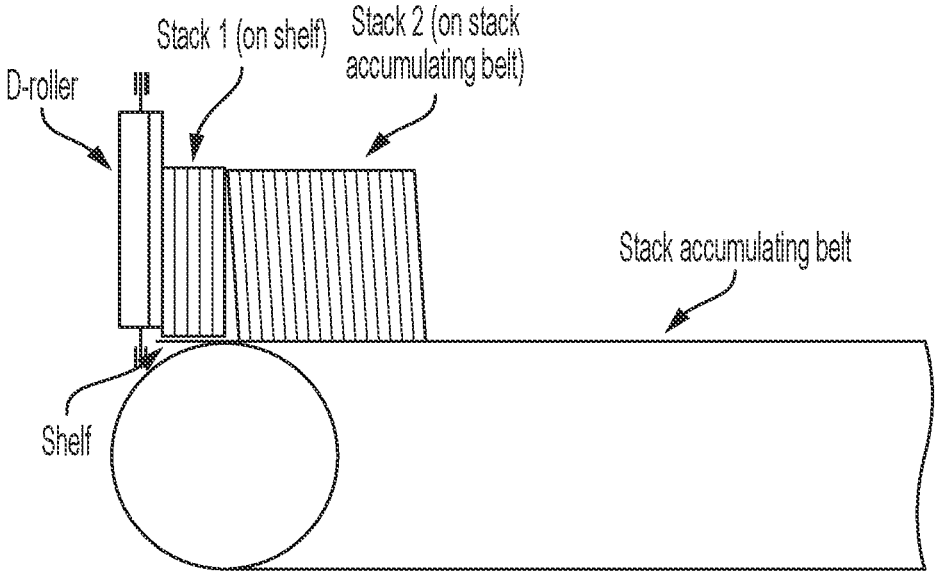
FIG. 9 is an enlarged schematic side view of the on-edge stacker module illustrating the arrangement of an exemplary D-roller relative to incoming on-edge envelopes and the envelope stacking section.

FIGS. 6 and 7 are enlarged, front-facing and rear-facing views, respectively, of the stacking section of the on-edge stacker module illustrating the processing of an on-edge envelope and the associated sensors for sensing the incoming on-edge envelope and subsequently measuring a force applied upon the envelope stacking section (i.e., via a load cell) to determine appropriate movement of the accumulating belt and subsequent insertion of the on-edge envelope into the stack. FIGS. 8A and 8B are enlarged, perspective views of the stacking section of the on-edge stacker module illustrating movement of the on-edge envelope into the stack. FIG. 9 is an enlarged schematic side view of the on-edge stacker module illustrating the arrangement of an exemplary D-roller relative to incoming on-edge envelopes and the envelope stacking section.

As shown, the stacking section includes D-rollers that are configured to serve at least two functions, which include: 1) remaining in a stationary state, in which corners of each D-roller extend toward the envelope stack and provide support to the stack while simultaneously preventing an incoming on-edge envelope from coming into collision with the stack; and 2) rotating to thereby move an incoming on-edge envelope toward the stack registration wall for insertion into the rear position of the envelope stack. The stacking section further includes an urge roller that is also configured to provide support to the stack while further assisting with the movement of the incoming on-edge envelope toward the stack registration wall so that the on-edge envelope can be inserted into the stack.

The stacking section further includes the force sensor, which is in the form of a load cell that is operably coupled to the D-rollers, urge roller, and the surrounding frame. Accordingly, the load cell is configured to measure stack pressure (i.e., the amount of force exerted upon the D-rollers, urge roller and surrounding frame). The stacking section further includes an exit sensor, which may be in the form of a photocell sensor, that is configured to detect the arrival of an on-edge envelope as it passes from the belt turn-up assembly and into the stacking section. Upon receiving the signal from the photocell sensor indicating the arrival of the on-edge envelope, the stack pressure is measured. In this moment, the D-rollers are in the stationary state, in which the leading edge of the envelope is prevented from moving further toward the stack registration wall while the corners of the D-rollers are supporting a portion of the stack (along with the urge roller).

Upon receiving data from the thickness sensor (i.e., a measurement of thickness of the on-edge envelope queued up to be inserted into the stack) and data from the load sensor (i.e., stack pressure), the controller is configured to determine how far to advance the stack accumulating belt to accommodate the on-edge envelope while maintaining a constant ideal stack pressure of the given stack of envelopes. As such, when an envelope arrives at the stacking section, the force sensor is sampled and the force reading is compared to the ideal stack force configuration setting. If the measured stack force is less than an ideal force setpoint, then the accumulating belt is stopped if already moving and will remain stopped until the next envelope arrives. If the measured stack force is greater than the ideal force setpoint, then the accumulating belt indexes forward a certain distance, as calculated by the stack accumulating belt control algorithm.

Figure 10:
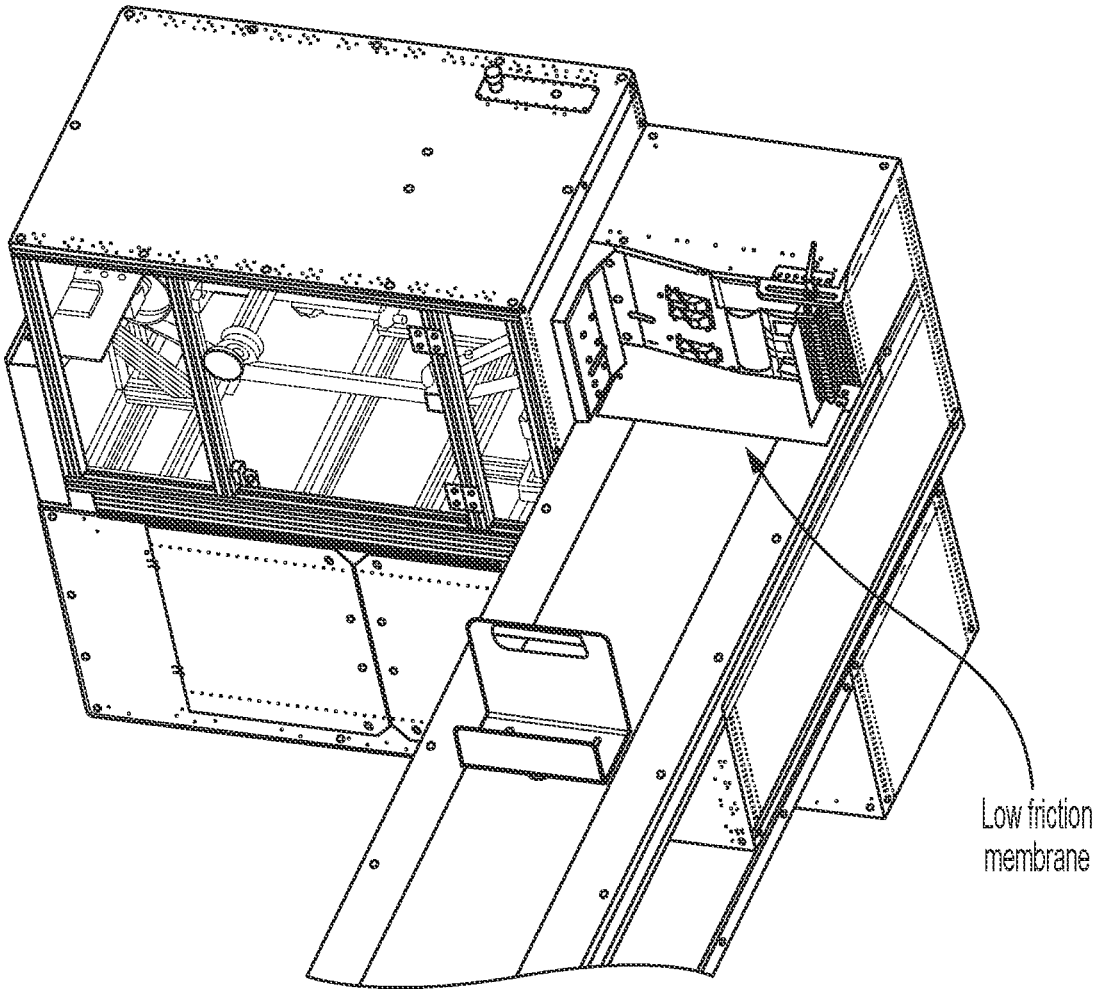
FIG. 10 is a perspective view of the stacking section of the on-edge stacker module including a low friction membrane covering a portion of the stack accumulation belt adjacent to the registration wall to thereby reduce friction between envelope edges and the belt and improve movement thereof.

FIG. 10 is a perspective view of the stacking section of the on-edge stacker module including a low friction membrane covering a portion of the stack accumulation belt adjacent to the registration wall. Referring to FIG. 4, when the leading edge of an incoming envelope passes the photocell sensor (shown at PC_exit), for example, it triggers actuation of the one or more D-rollers. The D-roller rotates and engages with the incoming envelope, driving it towards the registration wall and pushing a stack of accumulated envelopes away from the stacking section, thereby forcing edges of the stacked envelopes to slide over surfaces of the shelf and stack accumulation belt. When the D-roller retracts, the stack expands, which forces envelopes to move backwards. During stack expansion, the friction between envelope edges and the belt may cause the bottom edges of the envelopes to become stuck, while the top portions of the envelopes are able to spring back, which causes the stack to lean backwards (stack 2 in FIG. 9). To address this, a low friction membrane may be provided and used to cover a portion of the stack accumulation belt adjacent to the registration wall and used to reduce friction between envelope edges and the belt and improve movement thereof. In particular, the low friction membrane allows the bottom edges of the envelopes to slide freely during movement thus prevent the stack from leaning backwards.

Accordingly, the present invention essentially provides a closed loop system configured to automatically adjust movement of the accumulator belt on-the-fly by accounting for at least a thickness of each successive incoming mailpiece, such that each incoming mailpiece can be accommodated within a given stack provided at the mailpiece stacking section while maintaining a constant ideal stack pressure for that given stack. As a result, the system of the present invention provides improved quality of a resulting stack of mailpieces. Furthermore, the system of the present invention removes the need for constant manual adjustments to account for changes in mailpiece characteristics, specifically any changes in a given mailpiece thickness, and therefore greatly reduces the number of errors (i.e., jams and the like) from occurring and thus provides a significant improvement in the mean number of pieces produced between errors at the stacker module.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smartphones, etc.

Any of the operations described herein may be implemented in a system that includes one or more storage mediums having stored thereon, individually or in combination, instructions that when executed by one or more processors perform the methods. Here, the processor may include, for example, a server CPU, a mobile device CPU, and/or other programmable circuitry.

Also, it is intended that operations described herein may be distributed across a plurality of physical devices, such as processing structures at more than one different physical location. The storage medium may include any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions. Other embodiments may be implemented as software modules executed by a programmable control device. The storage medium may be non-transitory.

As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

The invention claimed is:

1. A system for providing autonomous on-edge stacking of mailpieces, the system comprising:

an on-edge stacker module configured to sequentially receive a plurality of incoming mailpieces in a flat position and reorient each mailpiece to an on-edge position and stack the plurality of on-edge mailpieces face-to-face in a given stack on a stack accumulating belt, wherein the on-edge stacker module comprises:

at least a first sensor configured to measure a thickness of an incoming mailpiece; and a second sensor configured to measure a pressure of a given stack of on-edge mailpieces into which the incoming mailpiece is to be inserted upon being reoriented into an on-edge position;

wherein the first sensor is configured to measure the thickness of the incoming mailpiece as it passes into the stacker module toward a belt turn-up assembly for reorienting incoming mailpiece from the flat position to the on-edge position; and a controller configured to communicate and exchange data with the on-edge stacker module, the controller comprising a hardware processor coupled to non-transitory, computer-readable memory containing instructions executable by the processor to cause the controller to:

receive and process data from one or more sensors of the on-edge stacking module; and autonomously control movement of at least the stack accumulating belt based, at least in part, on the processing of data to thereby maintain a constant ideal stack pressure of a given stack of on-edge mailpieces as each incoming mailpiece is received, reoriented, and subsequently inserted into the given stack.

2. The system of claim 1, wherein the first sensor comprises a position sensor operably associated with entrance nips configured to receive the incoming mailpiece.

3. The system of claim 1, wherein the second sensor is operably associated with a stacking section of the stacker module, the stacking section being configured to receive on-edge mailpieces from the belt turn-up assembly and subsequently insert on-edge mailpieces into a given stack.

4. The system of claim 3, wherein the second sensor comprises a load cell operably associated with the stacking section and configured to measure a force applied from a given stack of on-edge mailpieces upon the stacking section.

5. The system of claim 4, wherein the stacking section comprises one or more D-rollers configured to transition between a stationary state and a rotating state, wherein:

when in a stationary state, a corner of the one or more D-rollers extends toward a given stack of on-edge mailpieces and provide support to said stack while simultaneously preventing an incoming on-edge envelope from colliding with said stack; and when in a rotating state, the one or more D-rollers move the incoming on-edge mailpiece toward a stack registration wall for subsequent insertion into a rear position of said stack.

6. The system of claim 5, wherein the stacking section comprises at least one urge roller configured to provide support to said stack while further assisting with movement of the incoming on-edge mailpiece toward the stack registration wall for subsequent insertion into the rear position of said stack.

7. The system of claim 4, wherein the load cell is operably associated with the one or more D-rollers and urge roller.

8. The system of claim 6, further comprising a third sensor configured to detect the arrival of on-edge mailpieces from the belt turn-up assembly.

9. The system of claim 8, wherein the third sensor comprises a photocell.

10. The system of claim 8, wherein, upon receipt of a signal from the third sensor indicating the arrival of an on-edge mailpiece, the one or more D-rollers and the at least one urge roller are held in a stationary state and the load cell sensor measures the force applied from the given stack upon the stacking section.

11. The system of claim 10, wherein the controller is configured to process a thickness measurement from the first sensor that is associated with the thickness of an on-edge mailpiece at the stacking section and queued up to be inserted into the given stack and a force measurement from the second sensor that is associated with a pressure being applied upon the stacking section from the given stack.

12. The system of claim 11, wherein, based on said processing of data, the controller is configured to determine a level of advancement of the stack accumulating belt so as to accommodate the queued up on-edge mailpiece within the given stack while maintaining a constant ideal stack pressure of the given stack.

13. The system of claim 12, wherein the determined level of advancement is based, at least in part, on an ideal stack force configuration setting.

14. The system of claim 13, wherein:

if the measured stack force is less than an ideal stack force setpoint, then the controller stops the stack accumulating belt if the belt is already moving and will remain stopped until the next on-edge mailpiece arrives at the stacking section; and if the measured stack force is greater than the ideal stack force setpoint, then the controller indexes the stack accumulating belt forward an associated distance.

15. The system of claim 1, further comprising a low friction membrane covering a portion of the stack accumulating belt and configured to reduce friction between bottom edges of the plurality of on-edge mailpieces in a given stack and the stack accumulating belt to thereby improve movement of the given stack.

* * * * *